United States Patent [19]

Asanae et al.

[11] Patent Number: 5,064,739

[45] Date of Patent: Nov. 12, 1991

[54] METHOD OF DEVELOPING ELECTROSTATIC CHARGE PATTERN WITH MAGNETIC DEVELOPER

[75] Inventors: Masumi Asanae, Kumagaya; Fumio Kimura, Isesaki; Ryuji Gotoh, Fukaya, all of Japan

[73] Assignee: Hitachi Metals, Ltd., Tokyo, Japan

[21] Appl. No.: 476,782

[22] Filed: Feb. 8, 1990

[30] Foreign Application Priority Data

Feb. 13, 1989 [JP] Japan ..... 01-033302

[51] Int. Cl.[5] ..... G03G 9/14

[52] U.S. Cl. ..... 430/122; 430/106.6

[58] Field of Search ..... 430/106.6, 122

[56] References Cited

U.S. PATENT DOCUMENTS

| | | | |
|---|---|---|---|
| 4,640,880 | 2/1987 | Kawanishi et al. | 430/106.6 |
| 4,654,287 | 3/1987 | Okuyama et al. | 430/106.6 |
| 4,803,142 | 2/1989 | Takagi et al. | 430/106.6 |
| 4,816,364 | 3/1989 | Oishi et al. | 430/106.6 |

FOREIGN PATENT DOCUMENTS

| | | |
|---|---|---|
| 5797545 | 10/1980 | Japan . |
| 59-162563 | 8/1983 | Japan . |
| 62-275080 | 11/1987 | Japan . |
| 62-275280 | 11/1987 | Japan . |

*Primary Examiner*—John Goodrow

[57] ABSTRACT

In a method of developing a electrostatic charge pattern in which a magnetic brush is formed by supplying a developer consisting of a magnetic carrier and a magnetic toner onto a non-magnetic sleeve disposed so as to face an image carrier surface and incorporating a magnetic field producing member, the magnetic toner contains 25 to 60% by weight of a magnetic powder and the coercive force of the magnetic toner is not greater than 60 Oe. Preferably, the coercive force of the magnetic toner is not smaller than 15 Oe. The magnetic toner is composed, of, for example, styrene$_n$-butylacrylate copolymer, magnetite and a charge control agent.

6 Claims, 1 Drawing Sheet

METHOD OF DEVELOPING ELECTROSTATIC CHARGE PATTERN WITH MAGNETIC DEVELOPER

BACKGROUND OF THE INVENTION

This invention relates to a method of developing an electrostatic charge pattern formed on the surface of an image carrier member and, more particularly, to a method of developing such a pattern based on a magnetic brush method by using a developer composed of a magnetic carrier and a magnetic toner.

Ordinarily, a magnetic brush method is used for development of electrostatic charge patterns formed on image carrier surfaces, and binary developers in which a magnetic carrier and a non-magnetic toner are mixed are generally used as toners for magnetic brush development. A method of using a one-component developer having a resin and a magnetic powder as a developer is also known. The former method of using a binary developer ensures formation of images improved in image density and resolution but entails the problem of the image being inferior in reproduction of halftones. The method of using a one-component developer entails the problem of the occurrence of toner charging agglomeration with an increase in the toner charge and the problem of underdevelopment due to deficiency of toner on the sleeve surface serving as a developer supplying means. A means for solving these problems has been proposed which is based on using a type of developer such as those disclosed in Japanese Patent Unexamined Publication No. 59-162563 and U.S. Pat. No. 4,640,880. This type of developer is recognized to have both the advantages corresponding to those of the above two types of conventional developers, i.e., the binary developer and the one-component developer.

Although the method of developing an electrostatic charge pattern by using a developer consisting of a mixture of a magnetic carrier and a magnetic toner has both the advantages corresponding to those of the methods of using a binary developer and the method of using a one-component developer, it entails the problem cf a reduction in the definition of the pattern if the coercive force of the magnetic toner or the magnetic powder content in the magnetic toner is small. This is because the developer carrying performance of the non-magnetic sleeve incorporating a magnetic field producing member such as a permanent magnet and disposed so as to face the image carrier surface (or photosensitive body) is so inferior that the supply of the magnetic toner for the consumption owing to the friction between the magnetic brush and the image carrier surface is inadequate and that the magnetic carrier density is therefore increased. It is undesirable to simply increase the rotational speed of the sleeve or the magnetic field producing member serving as the developer supplying means in order to solve this problem, because increasing the rotational of this member produces noise and considerably deteriorates the environment. Also, increasing the outside diameter of the sleeve or the magnetic field producing member is not acceptable because it is contrary to recent demands for development apparatus reduced in size, thickness or weight.

To solve these problems, the applicant of the present invention has applied for a patent relating to the composition of a magnetic toner in which the coercive force is 50 to 600 Oe while the magnetic powder content is within a range of 10 to 75% by weight, and in which the coercive force is not smaller than 150 Oe when the magnetic powder content is less than 50% by weight, or is not larger than 250 Oe when the magnetic powder content is equal to or larger than 50% by weight (refer to Japanese Patent Unexamined Publication No. 62-275280).

This improvement invention solves the problems of the conventional art and, hence, formation of sharp images with improved transfer and fixation performance based on using a electrostatic charge pattern development method in which a magnetic carrier and a magnetic toner are used. However, it has been proved that this improvement invention does not eliminate of the possibility of occurrence of a tailing phenomenon, i.e., a phenomenon in which a slight amount of magnetic toner is attached to the rear end of the image pattern. This phenomenon is considerable particularly in the case of a solid-black image (in which the area of the black portion is excessively increased). A further improvement in this kind of development method is therefore required.

SUMMARY OF THE INVENTION

It is therefore an object of the present invention to provide an electrostatic charge pattern development method which is free from the above-described problems of the conventional art and free from some defects of the invention provided for some improvements prior to the present invention, which is improved in the fixing performance as well as in the transfer performance, and which enables formation of sharp images without any tailing phenomenon.

To achieve this object, according to the present invention, there is provided an electrostatic charge pattern development method in which an electrostatic charge pattern is formed on an image carrier surface, a developer consisting of a mixture of a magnetic carrier and a magnetic toner is supplied onto an outer peripheral surface of a non-magnetic sleeve disposed so as to face the image carrier surface and incorporating a magnetic field producing member, and the image carrier surface is brushed with a magnetic brush formed on the non-magnetic sleeve to develop the electrostatic charge pattern, and in which the content of a magnetic powder in the magnetic toner ranges from 25 to 60% by weight while the coercive force of the magnetic toner is not greater than 60 Oe.

Preferably, according to the present invention, the magnetic field producing member and the non-magnetic sleeve are supported so as to be rotatable relative to each other, and the coercive force of the magnetic toner is not smaller than 15 Oe.

According to the present invention, the resolution is reduced and the fog density is increased if the content of the magnetic powder in the magnetic toner is less than 25% by weight. Also, under this condition, the saturated magnetization of the magnetic toner is considerably reduced and the magnetic toner is easy to remove from the non-magnetic sleeve, resulting in flying and scattering of the toner. If the magnetic powder content exceeds 60% by weight, the image-fixing performance and the image density are reduced and the extent of tailing, i.e., a phenomenon in which a surplus amount of the magnetic toner is attached to the rear end of the image is increased, which is undesirable.

If the coercive force of the magnetic toner exceeds 60 Oe, the extent of tailing becomes considerably large. In a case where at least the magnetic field producing member that, together with the non-magnetic sleeve, constitutes the development roll is rotated, if the coercive force of the magnetic toner is smaller than 15 Oe, the desired effect of the rotating magnetic field cannot be obtained and the magnetic toner does not rotate on the peripheral surface of the non-magnetic sleeve, that is, the electrifying characteristics and carrying performance are deteriorated, which effect is undesirable.

The carrier used for the present invention may be of a well-known type. It is preferable for the carrier in terms of image quality to contain iron oxide consisting of magnetite or soft ferrite (such as Ni-Zn, Mg-Zn, Cu-Zn or Ba-Ni-Zn ferrite).

Preferably, the average grain size of the carrier is within a range of 20 to 200 μm (more preferably, 50 to 150 μm), as in the case of the ordinary binary developer.

The magnetic toner used for the present invention is prepared by mixing a fixing resin, a magnetic powder and various additives (a charge control agent, a resistance control agent, a flowability improving agents, and so on) selected as desired.

The fixing resin may be selected according to the fixing method (refer to, for example, Japanese Patent Unexamined Publication No. 57-97545). For example, in the case of the heat roll fixing method, the fixing resin is selected from styrene-acrylonitrile copolymer, styrenebutadiene copolymer, polyester resin, epoxy resin and mixtures of these resins.

The magnetic powder may be formed of an alloy or compound containing some ferromagnetic elements such as ferrite, magnetite, iron, cobalt, nickel and so on. Preferably, the average particle size of this powder is about 0.1 to 3 μm because the powder is contained in the toner. The coercive force of the toner is prescribed substantially with the coercive force of the magnetic powder, and it is therefore possible to change the coercive force of the toner by changing the type of magnetic powder Examples of the additives are shown below. Nigrosine dye having positive charge characteristics and metal (e.g., Cr) containing azo dye having negative charge characteristics are commonly used as the charge control agent. Carbon black is commonly used as the resistance control agent. Hydrophobic silica is usually used as the flowability improving agent. Ordinarily, the content of each of these additives is limited to 15% or less because if it is excessively large, the fixing performance of the toner is impaired.

The average particle size of various components of the toner is set to 5 to 30 μm (preferably, 10 to 20 μm) as in the case of the ordinary one-component developer.

The developer used for the present invention is prepared by mixing the carrier and the toner. Preferably, the toner mixing ratio (toner concentration) is set to 10 to 95% by weight. If the toner density exceeds 95%, the toner tends to fly off and the amount of spent toner is increased. If the toner density is lower than 10% by weight, the sharpness of the image is reduced, resulting in occurrence of spreading or blur. The toner density is determined according to the development conditions and other conditions. It is more preferable to set the toner density to a range of 20 to 80% by weight or, still more preferably, 30 to 80% by weight.

It is desirable to use a development carrying method based on rotating at least the sleeve in order to prevent magnetic agglomeration of the carrier. Alternatively, a method of rotating the sleeve and the magnetic producing member, e.g., a permanent magnet roll in the same direction or opposite directions may be adopted.

The development gap suitable for maintaining the contact width between the magnetic blush and the photosensitive body is 1.0 mm or less. However, it is preferable to set the development gap to 0.2 mm or more in order to make the magnetic brush softly contact the photosensitive body. More preferably, the development gap is within a range of 0.3 to 0.6 mm. The doctor gap may be set according to the development gap.

The magnetic characteristics of the developer in accordance with the present invention were measured with a vibration sample magnetometer (VSM-3 made by Tohei Kohgyo K.K.) by using a magnetic field of at most 10 kOe.

DETAILED DESCRIPTION OF THE INVENTION

Figure 1:
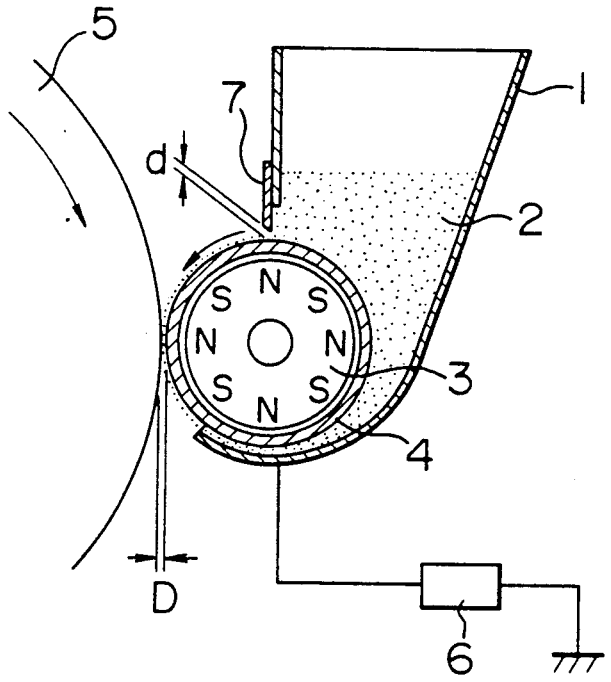
FIG. 1 is a schematic cross-sectional view of a development apparatus relating to embodiments of the present invention.

Referring to the drawing, a toner bath 1 is illustrated which contains a magnetic toner 2. A permanent magnet roll 3 having magnetic poles N, S on its surface is disposed at the bottom of the toner bath 1, and a sleeve 4 is disposed coaxially with the permanent magnet roll 3. The permanent magnet roll 3 and the sleeve 4 are rotatable relative to each other. The sleeve 4 is a hollow cylindrical body formed of a non-magnetic material, e.g., stainless steel. A photosensitive body 5 in the form of a drum is disposed so as to rotatable in the direction of the arrow with a development gap "D" formed between the photosensitive body 5 and the sleeve 4. A bias voltage source 6 is connected to the sleeve 4 to apply a voltage thereto for preventing the magnetic toner electrified with the same polarity as the carrier from attaching to the electrostatic charge pattern and thereby causing background fog. Preferably, a low-frequency alternating current voltage having a frequency of lower than 2 kHz is applied as the bias voltage.

In the thus-constructed apparatus, the permanent magnet roll 3 and the sleeve 4 are rotated relatively oppositely and the magnetic toner 2 contained in the toner bath 1 is transported by the sleeve 4 while being agitated through a doctor gap "d" formed between the sleeve 4 and a doctor blade 7 attached to a wall of the toner bath 1, thereby forming a magnetic brush based on the effect of magnetic poles formed on the surface of the permanent magnet roll 3. The surface of the photosensitive body 5 is brushed with the magnetic brush to develop the electrostatic charge pattern formed on the photosensitive body 5.

DESCRIPTION OF THE PREFERRED EMBODIMENTS

The present invention will be described below in more detail with respect to examples of experiments.

The composition of the developer was as shown below.

| | |
|---|---|
| Ferrite carrier | 60% by weight |

(KBN-100 made by Hitachi Kinzoku K.K., having a particle size of 74 to 149 μm)

| Magnetic toner | 40% by weight |
|---|---|

(having a particle size of 5 to 20 μm, a volume resistivity of $10^{14}$ Ω.cm or higher in an electric field of a direct current voltage of 4000 V/cm, and a blow-off charge of −15 to −25 μc/g)

The magnetic toner was prepared by blending styrene-$e_n$-butylacrylate copolymer (Mw=200,000, Mn=30,000), magnetite (made by Toda Kohgyo K.K. (for the content and the coercive force, refer to a table shown below), and 3 parts by weight of a charge control agent (Bontron E81 made by Orient Kagaku K.K.). That is, a mixture of these components was kneaded at 200° C., solidified by being cooled and pulverized. 0.1% by weight of silica (R972 made by Kippon Aerozil K.K.) was added to the mixture, followed by heat treatment at 120° C., classification and the like. A magnetic toner having a particle size of 5 to 20 μm was thereby prepared.

Images formed by using developers formed by mixing the thus-prepared magnetic toner and the ferrite carrier were evaluated. First, an OPC drum (peripheral speed: 60 mm/sec) was used as the photosensitive body 5. After being uniformly electrified at −600V, it was subjected to split exposure with a semiconductor laser to form an electrostatic charge pattern on its surface. In the development apparatus, a permanent magnet roll 3 having an outside diameter of 28 mm, 10 pole-magnetized and having a surface magnetic flux density of 700 G and a sleeve 4 formed of stainless steel and having an outside diameter of 29.5 mm were used. The development gap "D" was set to 0.4 mm while the doctor gap "d" was set to 0.3 mm. The sleeve 4 was rotated counterclockwise at 200 r.p.m. and the permanent magnet 3 was rotated at 1000 r.p.m. opposite to the rotation of the sleeve 4. In this case, the bias voltage was set to −500V. The developed pattern was transferred to ordinary paper and was fixed by a heat roll under the conditions of a fixing temperature of 180° C. and a fixing pressure of 0.5 kg/cm. The environmental conditions were 20° C., 60% R.H.

EXAMPLE 1

Table 1 shows the results of evaluation of the images formed by the developers having toners prepared by changing the content of magnetite (MAT305, coercive force of 58 Oe) used for the magnetic powder.

Symbols and values shown in Table 1 are based on the following criteria.

| | |
|---|---|
| Resolution | ○: 8 or more lines/mm, Δ: 6.3 lines/mm |
| Fog density | ○: <0.1, Δ: ≧0.1, x: ≧0.2 |

Tailing (evaluated by measuring the trailing length)
1: not longer than 0.5 mm
2: not longer than 1 mm
3: not longer than 1.5 mm
4: not longer than 2 mm
5: larger than 2 mm

TABLE 1

| No. | Content (wt %) | Image density | Resolution | Fog | Tailing |
|---|---|---|---|---|---|
| 1 | 65 | 1.1 | ○ | ○ | 5 |
| 2 | 60 | 1.3 | ○ | ○ | 4 |

TABLE 1-continued

| No. | Content (wt %) | Image density | Resolution | Fog | Tailing |
|---|---|---|---|---|---|
| 3 | 50 | 1.4 | ○ | ○ | 2 |
| 4 | 40 | 1.5 | ○ | ○ | 1 |
| 5 | 30 | 1.5 | Δ | Δ | 1 |
| 6 | 20 | 1.5 | Δ | x | 1 |

As is apparent from Table 1, in the case of the toner 1, the image density was low and the extent of tailing was considerably large owing to a comparatively large content of magnetite used for the magnetic powder. In the case of the toner 6, the resolution was slightly lower and the extent of fog owing to scattering of the toner was extremely large. In contrast, in the case of each of the toners 2 to 5, the extent of tailing was small and the results were good with respect to other image characteristics also.

EXAMPLE 2

Table 2 shows the results of evaluation of the images formed by the developers having magnetic toners prepared by changing the coercive force of magnetite used for the magnetic powder while setting the content of the magnetic powder to 50% by weight.

TABLE 2

| No. | Article | Coercive force (Oe) | Image density | Resolution | Fog | Tailing |
|---|---|---|---|---|---|---|
| 1 | EPT 500 | 123 | 1.4 | ○ | ○ | 5 |
| 2 | MAT 305 | 58 | 1.4 | ○ | ○ | 2 |
| 3 | TR-1025 | 30 | 1.4 | ○ | ○ | 1 |
| 4 | TR-2003 | 19 | 1.4 | ○ | ○ | 1 |

As is apparent from Table 2, the toner 1, which is a conventional toner having a comparatively large coercive force, greatly increased the extent of tailing, resulting in a reduction in the image quality. In contrast, the toners 2 to 4 enabled improved image characteristics as well as a remarkable reduction in the extent of tailing.

As will be apparent from the above description, the present invention enables improvements in the transfer performance and the fixing performance and, hence, formation of sharp and high-quality images free from tailing phenomena without impairing other image characteristics.

What is claimed is:

1. A method of developing an electrostatic charge pattern formed on an image carrier surface, the method comprising the steps of supplying a developer consisting of a mixture of a magnetic carrier and a magnetic toner onto a non-magnetic sleeve disposed so as to face the image carrier surface and incorporating a magnetic field producing member, and brushing the image carrier surface with a magnetic brush formed on a peripheral surface of the non-magnetic sleeve to develop the electrostatic charge pattern, the developer being preselected to substantially reduce the "tailing" phenomenon, the magnetic carrier containing iron oxide, the magnetic toner containing magnetite, the content of magnetite in the magnetic toner ranging from 25 to less than 50% by weight; the coercive force of the magnetic toner being not greater than 60 Oe; and the magnetic toner being from 10–95 wt % of the developer.

2. A method of developing an electrostatic charge pattern according to claim 1, wherein the supplying step includes the step of rotating the magnetic producing member and the non-magnetic sleeve relative to each other, and the preselecting step includes preselecting the magnetic toner to have a coercive force not smaller than 15 Oe.

3. A developer for developing an electrostatic charge pattern in a magnetic brush-type development apparatus for reducing substantially the "tailing" phenomenon, the developer comprising a magnetic carrier containing iron oxide and having an average size of 20 to 200 μm; and a magnetic toner containing at least a fixing resin, magnetite and a charge control agent and having an average particle size of 5 to 30 μm, the content of magnetite in the magnetic toner ranging from 25 to less than 50% by weight, the coercive force being not greater than 60 Oe.

4. A developer according to claim 3, wherein the content of the magnetic toner in the developer containing the magnetic carrier and the magnetic toner ranges from 10 to 95% by weight.

5. The method as in claim 1 wherein the magnetite content ranges from 30 to less than 50 wt % of the magnetic toner.

6. The developer as in claim 3 wherein the magnetite content ranges from about 30 to less than 50 wt % of the magnetic toner.

* * * * *